US011309150B2

(12) United States Patent
Chou

(10) Patent No.: US 11,309,150 B2
(45) Date of Patent: Apr. 19, 2022

(54) SENSOR SWITCH

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 0 days.

(21) Appl. No.: 17/083,133

(22) Filed: Oct. 28, 2020

(65) Prior Publication Data

US 2021/0358703 A1 Nov. 18, 2021

(30) Foreign Application Priority Data

May 12, 2020 (TW) ..... 109115726

(51) Int. Cl.
*H01H 35/02* (2006.01)
*H01H 11/04* (2006.01)
*H01H 1/16* (2006.01)

(52) U.S. Cl.
CPC ..... *H01H 35/02* (2013.01); *H01H 1/16* (2013.01); *H01H 11/04* (2013.01)

(58) Field of Classification Search
CPC ..... H01H 35/02; H01H 1/16; H01H 11/04; H01H 35/025; H01H 1/58; H01H 11/06; H01H 35/144; H01H 2001/0005; H01H 35/14; H01H 35/141
USPC ..... 200/52 r, 61.45 r, 61.52, 277, 1 r, 61.11, 200/85 r, 45 r–61.45 m
See application file for complete search history.

(56) References Cited

U.S. PATENT DOCUMENTS 5,672,856 A * 9/1997 Kolb ..... H01H 35/02 200/61.45 R
7,465,893 B2 * 12/2008 Chou ..... H01H 35/141 200/61.45 R
7,884,294 B2 * 2/2011 Chou ..... H01H 35/02 200/277
8,471,161 B2 * 6/2013 Chou ..... H01H 1/16 200/277
9,941,081 B1 * 4/2018 Chou ..... H01H 11/06

* cited by examiner

*Primary Examiner* — Lheiren Mae A Caroc
(74) *Attorney, Agent, or Firm* — Lewis Roca Rothgerber Christie LLP

(57) ABSTRACT

A sensor switch includes two electroconductive terminals and two electroconductive beads. The electroconductive terminals are spaced apart along an axis. Each of the electroconductive terminals has an inner surrounding surface surrounding the axis and having an indented segment indented away from the axis. The electroconductive beads are movably and respectively disposed in the electroconductive terminals. When the sensor switch is placed such that the axis horizontally leveled, the electroconductive beads are respectively retained in the indented segments of the electroconductive terminals to be spaced apart from each other so that the sensor switch is in an open state.

2 Claims, 5 Drawing Sheets

SENSOR SWITCH

CROSS-REFERENCE TO RELATED APPLICATION

This application claims priority of Taiwanese Invention Patent Application No. 109115726, filed on May 12, 2020.

FIELD

The disclosure relates to a sensor switch, more particularly to a normally open sensor switch.

BACKGROUND

Referring to FIG. 1, a conventional ball switch as disclosed by Taiwanese invention patent No. I321798 is a normally closed switch and includes a hollow casing 91 open at two ends, two metallic terminals 92 sealing the two ends of the hollow casing 91 and spaced apart from each other, and two rolling balls 93 disposed in the hollow casing 91. In a normal state, when the hollow casing 91 is stationary, the rolling balls 93 abut against each other and are in respective contact with the metallic terminals 92 so that the conventional ball switch is in a closed state. When the hollow casing 91 is shaken or vibrated, the rolling balls 93 separate from each other to that the conventional ball switch is in an open state.

The conventional ball switch cannot, based on the requirements of different products, be used in a product where the conventional ball switch is required to be normally open.

SUMMARY

Therefore, the object of the disclosure is to provide a sensor switch that is normally open.

According to the disclosure, a sensor switch includes an insulating casing, two electroconductive terminals, and two electroconductive beads.

The insulating casing includes two installation ends opposite along an axis, an extending portion interconnecting the installation ends, and an inner tubular surface constituting inner surfaces of the installation ends and the extending portion. The inner tubular surface surrounds the axis to define a tubular space which extends through the insulating casing.

The electroconductive terminals extends into the tubular space respectively through the installation ends and are spaced apart along the axis. Each of the electroconductive terminals has an inner surrounding surface surrounding the axis and facing the axis, and an inner end surface being connected to an edge of the inner surrounding surface which is distal to the other one of the electroconductive terminals and cooperating with the inner surrounding surface to define a receiving space. The inner surrounding surface of each of the electroconductive terminals has an indented segment indented away from the axis and extending annularly around the axis.

The electroconductive beads are movably and respectively disposed in the receiving spaces of the electroconductive terminals.

The sensor switch is configured to be convertible by an external force between an open state, where the electroconductive beads are spaced apart from each other so that the electroconductive terminals are not electrically connected to each other, and a closed state, where the electroconductive beads are in direct contact with each other and with the respective electroconductive terminals so that the electroconductive terminals are electrically connected with each other.

When the sensor switch is placed such that the axis is horizontally leveled, the electroconductive beads are respectively retained in the indented segments of the inner surrounding surfaces of the electroconductive terminals to be spaced apart from each other so that the sensor switch is in the open state.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
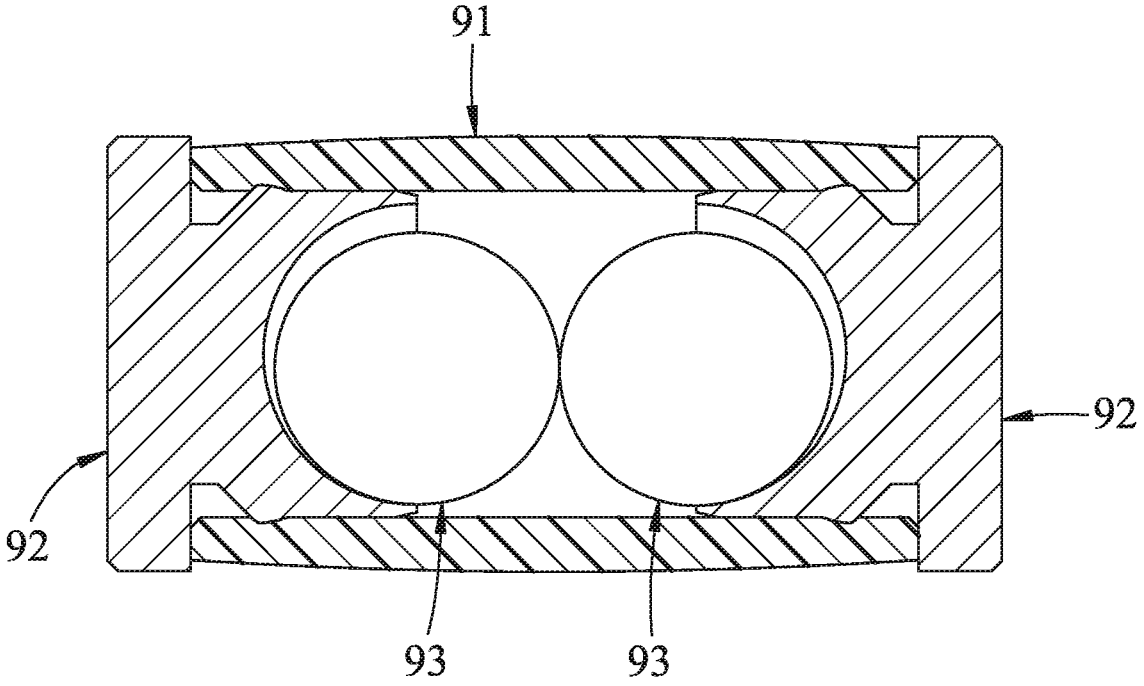
FIG.1 PRIOR ART
FIG. 1 is a partly sectional view of a conventional ball switch.
Figure 2:
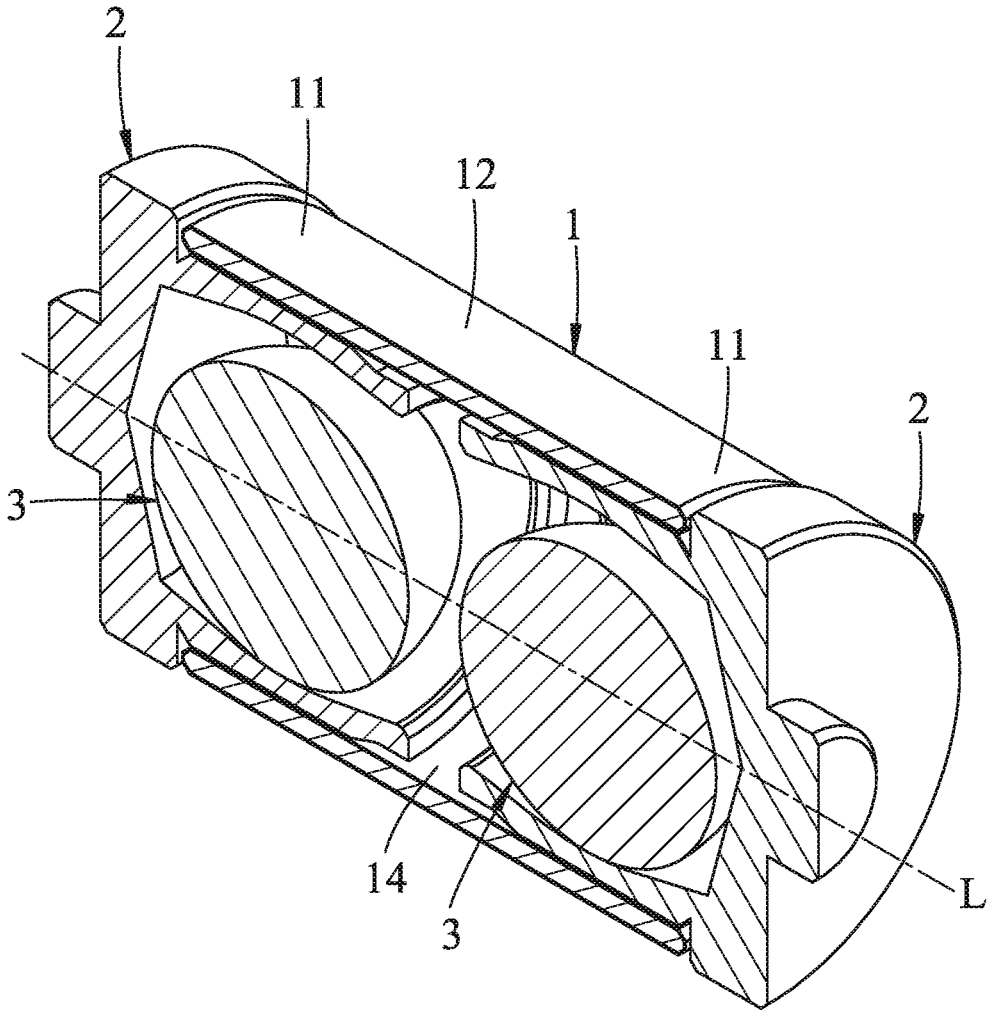
FIG. 2 is a cutaway view of an embodiment of a sensor switch according to the disclosure.
Figure 3:
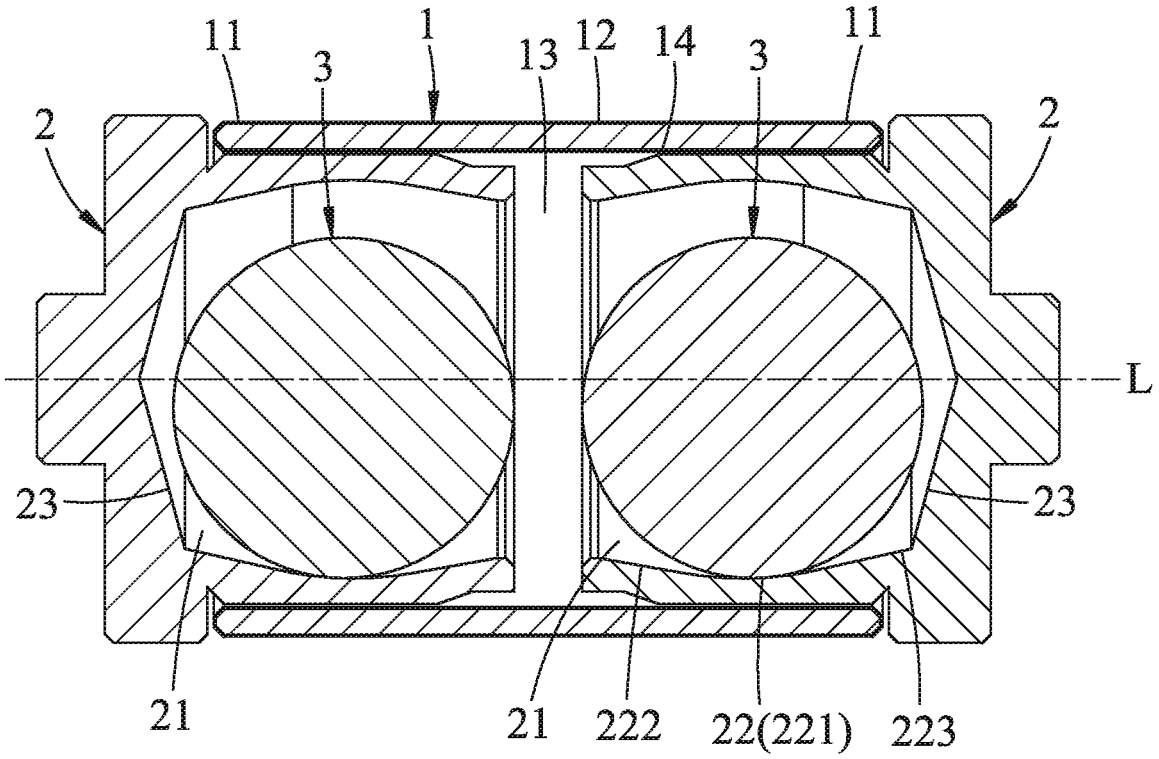
FIG. 3 is a sectional view of the embodiment in an open state.

Referring to FIGS. 2 and 3, an embodiment of a sensor switch according to the disclosure includes an insulating casing 1, two electroconductive terminals 2, and two electroconductive beads 3.

The insulating casing 1 includes two installation ends 11 opposite along an axis (L), an extending portion 12 interconnecting the installation ends 11, and an inner tubular surface 14 constituting inner surfaces of the installation ends 11 and the extending portion 12. The insulating casing 1 opens at the two installation ends 11. The inner tubular surface 14 surrounds the axis (L) to define a tubular space 13 which extends through the insulating casing 1. In this embodiment, the insulating casing 1 is made of a metallic material and an insulating material, e.g. a plastic film, covering the metallic material, but in other embodiments, the insulating casing 1 may be made entirely of an insulating material.

The electroconductive VP terminals 2 extends into the tubular space 13 of the insulating casing 1 respectively through the installation ends 11 and are spaced apart along the axis (L). In this embodiment, the electroconductive terminals 2 are secured to the insulating casing 1 by having respective portions being tightly and respectively fitted to the installation ends 11 within the tubular space 13, but is not limited thus.

Each of the electroconductive terminals 2 has an inner surrounding surface 22 surrounding the axis (L) and facing the axis, and an inner end surface 23 being connected to an edge of the inner surrounding surface 22 which is distal to the other one of the electroconductive terminals 2 and cooperating with the inner surrounding surface 22 to define a receiving space 21. The inner surrounding surface 22 of each of the electroconductive terminals 2 has an indented segment 221 indented away from the axis (L) and extending annularly around the axis (L), and a rollout segment 222 and a rollback segment 223 respectively extending from opposite sides of the indented segment 221.

Figure 4:
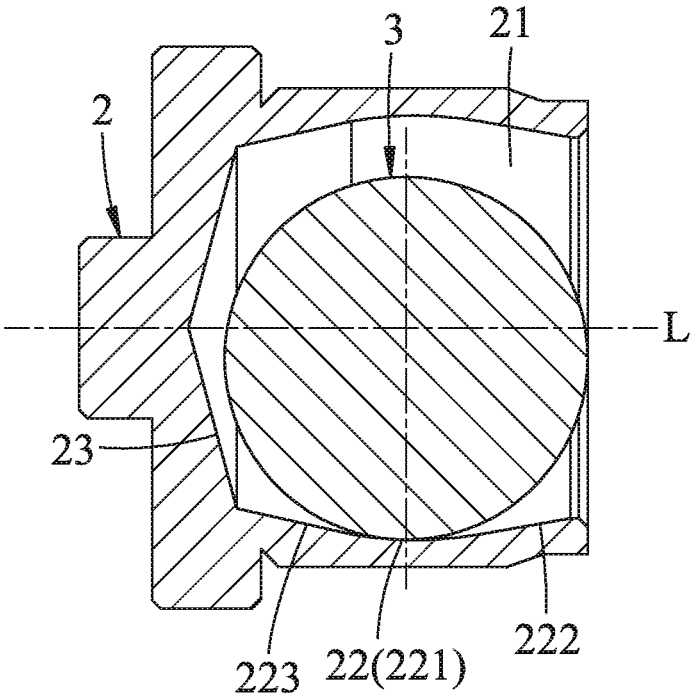
FIG. 4 is a sectional view of an electroconductive terminal and an electroconductive bead of the embodiment.

Referring to FIG. 4, for each of the electroconductive terminals 2, the rollout segment 222 extends from a side of the indented segment 221 which is proximal to the other one of the electroconductive terminals toward the other one of the electroconductive terminals 2, and tends toward the axis (L). Each of the rollout segments 222 of the electroconductive terminals 2 has a cross-section which is taken along the axis (L) (see FIG. 2) and which forms at least one angle between 3° and 65° with the axis (L). In this embodiment, the cross-section includes at least one straight line oblique to the axis (L) and each of the rollout segments 222 is connected smoothly with a respective one of the indented segments 221.

For each of the electroconductive terminals 2, the rollback segment 223 extends from a side of the indented segment 221 which is distal to the other one of the electroconductive terminals 2, interconnects the indented segment 221 and a respective one of the inner end surface 23, and tends toward the axis (L). In this embodiment, each of the rollback segments 223 has a cross-section taken along the axis (L) (see FIG. 2) and including at least one straight line oblique to the axis (L), and is connected smoothly with a respective one of the indented segments 221. The inner end surface 23 of each of the electroconductive terminals is indented away from the other one of the electroconductive terminals 2 to be conical in shape.

Referring to FIGS. 3 and 4, the electroconductive beads 3 are movably and respectively disposed in the receiving spaces 21 of the electroconductive terminals 2 and between the inner end surfaces 23 of the electroconductive terminals 2.

Figure 5:
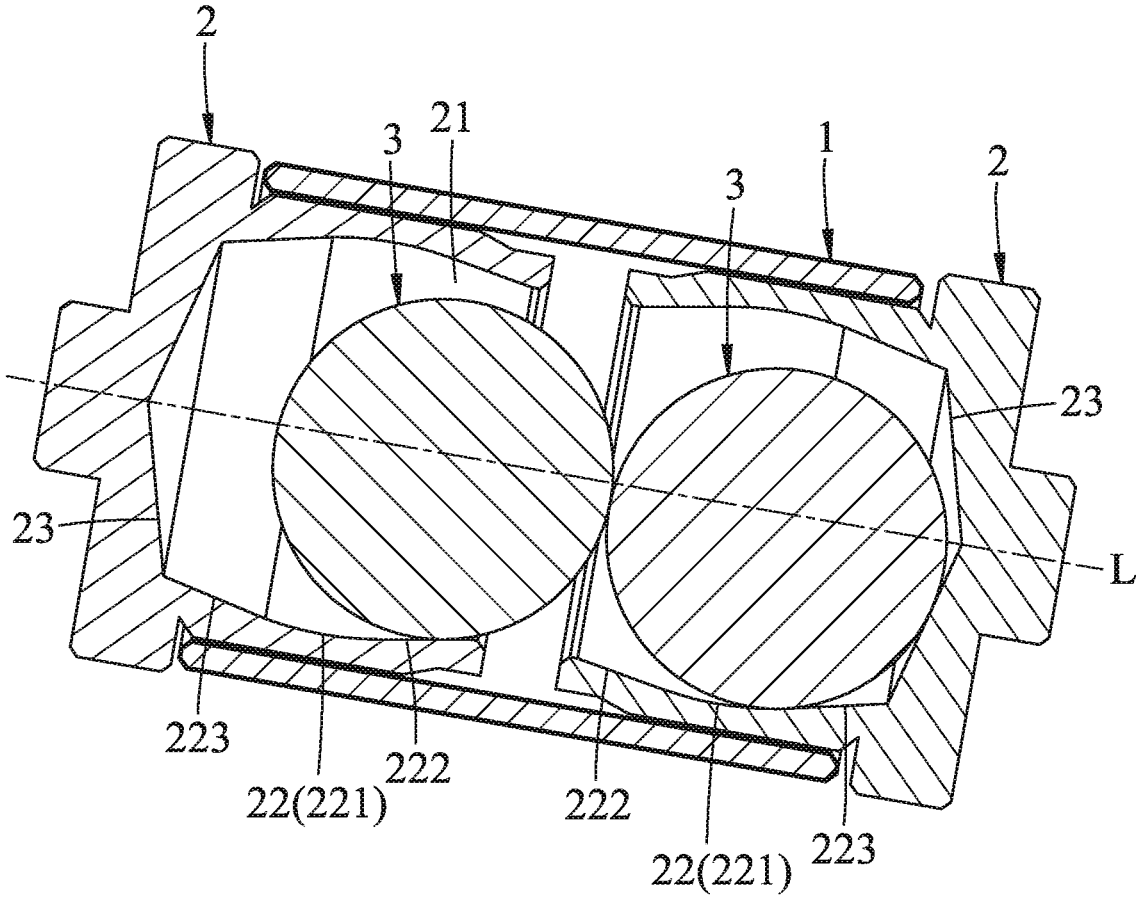
FIG. 5 is a sectional view of the embodiment in a closed state.

Referring to FIGS. 3 and 5, the sensor switch is configured to be convertible by an external force between an open state (see FIG. 3), where the electroconductive beads 3 are spaced apart from each other so that the electroconductive terminals 2 are not electrically connected to each other, and a closed state (see FIG. 5), where the electroconductive beads 3 are in direct contact with each other and respectively with tan electroconductive terminals 2 so that the electroconductive terminals 2 are electrically connected with each other. When the sensor switch is placed such that the axis (L) is horizontally leveled, the electroconductive beads 3 are respectively retained in the indented segments 221 of the inner surrounding surfaces 22 of the electroconductive terminals 2 to be spaced apart from each other so that the sensor switch is in the open state. When the sensor switch is placed such that the axis (L) is not horizontally leveled, one of the electroconductive beads 3 abuts against the other one of the electroconductive beads 3 so that the sensor switch is in the closed state.

When in use, the electroconductive terminals 2 are connected to an external circuit (not shown). When the sensor switch originally in the closed state is moved such that the axis (L) is horizontally leveled (i.e. the sensor switch is horizontally leveled), the rollout segment 222 of the inner surrounding surface 22 of one of the electroconductive terminals 2 biases a corresponding one of the electroconductive beads 3 to move so as to be retained by the indented segment 221 of the inner surrounding surface 22 of said one of the electroconductive terminals 2, thereby converting the sensor switch from the closed state to the open state. When the sensor switch is tilted or shaken such that the electroconductive beads 3 are brought into direct contact with each other and respectively with the electroconductive terminals 2, the electroconductive terminals 2 are electrically connected with each other so as to convert the sensor switch to the closed state. Specifically, when the sensor switch is placed such that the axis (L) is not horizontally leveled (i.e. the sensor switch is tilted), one of the electroconductive beads 3 rolls onto the rollout segment 222 of a corresponding one of the electroconductive terminals and abuts against the other one of the electroconductive beads 3, thereby pushing the other one of the electroconductive beads 3 onto the rollback segment 223 of the other one of the electroconductive terminals 2 and to abut against the inner end surface 23 of the other one of the electroconductive terminals 2.

It should be noted that when the electroconductive beads 3 are separated from each other, or when at least one of the electroconductive beads 3 is separated from the respective electroconductive terminal 2 for a short time due to the sensor switch being shaken, the electroconductive terminals 2 are not electrically connected to each other and the sensor switch is in the open state.

The benefits of the embodiment are as follows.

1. Due to the provision of the indented segment 221 of the inner surface 22 of each of the electroconductive terminals 2, the electroconductive beads 3 may be positioned so as to be separated from each other when the sensor switch is horizontally leveled. This allows the sensor switch to be normally in the open state.

2. The structure of the rollout segment 222 of each of the electroconductive terminals 2 allows each of the electroconductive beads 3 to easily roll onto the rollout segment 222 of the respective electroconductive terminal 2 to come into contact with the other one of the electroconductive beads 3 when the sensor switch is tilted, and biases each of the electroconductive beads 3 back toward the indented segment 221 of the respective electroconductive terminal 2 when the sensor switch is horizontally leveled. This improves sensitivity of the sensor switch.

3. The structure of the rollback segment 223 of each of the electroconductive terminals 2 encourages the electroconductive beads 3 to move toward each other when the sensor switch is shaken or tilted to improve sensitivity of the sensor switch.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A sensor switch comprising:

an insulating casing including two installation ends that are opposite along an axis, an extending portion that interconnects said installation ends, and an inner tubular surface that constitutes inner surfaces of said installation ends and said extending portion, and that surrounds said axis to define a tubular space which extends through said insulating casing;

two electroconductive terminals extending into said tubular space respectively through said installation ends and spaced apart along said axis, each of said electroconductive terminals having an inner surrounding surface that surrounds said axis and that faces said axis, and an inner end surface that is connected to an edge of said inner surrounding surface distal to another one of said electroconductive terminals and that cooperates with said inner surrounding surface to define a receiving space, said inner surrounding surface of each of said electroconductive terminals having an indented segment that is indented away from said axis and that extends annularly around said axis; and two electroconductive beads movably and respectively disposed in said receiving spaces of said electroconductive terminals;

wherein said sensor switch is configured to be convertible by an external force between an open state, where said electroconductive beads are spaced apart from each other so that said electroconductive terminals are not electrically connected to each other, and a closed state, where said electroconductive beads are in direct contact with each other and respectively with said electroconductive terminals so that said electroconductive terminals are electrically connected with each other;

wherein when said sensor switch is placed such that said axis is horizontally leveled, said electroconductive beads are respectively retained in said indented segments of said inner surrounding surfaces of said electroconductive terminals to be spaced apart from each other so that said sensor switch is in said open state;

wherein said inner surrounding surface of each of said electroconductive terminals further has a rollout segment extending from a side of said indented segment which is proximal to said another one of said electroconductive terminals toward said another one of said electroconductive terminals, and tending toward said axis;

wherein when said sensor switch is placed such that said axis is not horizontally leveled, one of said electroconductive beads rolls onto said rollout segment of a corresponding one of said electroconductive terminals and abuts against another one of said electroconductive beads, thereby pushing said another one of said electroconductive beads to abut against said inner end surface of another one of said electroconductive terminals;

wherein when said sensor switch originally in said closed state is moved such that said axis is horizontally leveled, said rollout segment of said inner surrounding surface of one of said electroconductive terminals bias a corresponding one of said electroconductive beads to move so as to be retained by said indented segment of said inner surrounding surface of said one of said electroconductive terminals, thereby converting said sensor switch from said closed state to said open state.

2. The sensor switch as claimed in claim 1, wherein said rollout segment of said inner surrounding surface of each of said electroconductive terminals has a cross-section which is taken along said axis and which includes at least one straight line oblique to said axis.

* * * * *